United States Patent [19]
Marlowe et al.
[11] 3,944,448
[45] Mar. 16, 1976

[54] THIXOTROPIC MONOPROPELLANT CONTAINING INORGANIC PHOSPHIDES OR PHOSPHIDE ALLOYS

[75] Inventors: Bernard Marlowe, Malvern, Pa.; Stanley Tannenbaum, Morristown, N.J.

[73] Assignee: Thiokol Corporation, Bristol, Pa.

[22] Filed: Apr. 22, 1964

[21] Appl. No.: 363,335

[52] U.S. Cl. ..... 149/22; 149/29; 149/74; 149/89; 149/108.2; 149/109.2
[51] Int. Cl.[2] ..... C06D 5/10
[58] Field of Search ..... 60/35.4; 149/22, 29, 74, 149/89, 108.2, 109.2

[56] References Cited

UNITED STATES PATENTS

| | | | |
|---|---|---|---|
| 3,092,959 | 6/1963 | Scurlock et al. | 149/36 X |
| 3,116,187 | 12/1963 | Scanlon et al. | 149/36 X |
| 3,197,348 | 7/1965 | Skolnik et al. | 149/17 |

*Primary Examiner*—Benjamin R. Padgett
*Assistant Examiner*—E. A. Miller
*Attorney, Agent, or Firm*—Stanley A. Marcus

EXEMPLARY CLAIM

1. Novel thixotropic, monopropellant compositions comprising a mixture of a solid fuel selected from the group consisting of inorganic phosphides, phosphide alloys and mixtures of these inorganic phosphides and phosphide alloys, a liquid oxidizer selected from the group consisting of nitric acid, nitric acid enriched with $NO_2$, nitric acid enriched with $NO_2$ and HF, nitrogen tetroxide, hydrogen peroxide, perchloryl fluoride, tetrafluorohydrazine, tetranitro methane and perchloric acid, and a thixotropic agent selected from the group consisting of particulated carbon and silica.

17 Claims, No Drawings

THIXOTROPIC MONOPROPELLANT CONTAINING INORGANIC PHOSPHIDES OR PHOSPHIDE ALLOYS

This invention relates to novel heterogeneous monopropellant compositions.

More particularly, this invention concerns the preparation of highly energetic, thixotropic propellant compositions which are superior in certain respects to presently utilized solid or liquid propellant compositions.

The novel, thixotropic propellant compositions of this invention are composed essentially of:

A. Fuels selected from the group consisting of inorganic phosphides, phosphide alloys and mixtures of these inorganic phosphides and phosphide alloys.

B. Liquid oxidizer.

C. Thixotroping or gelling agents and optional propellant adjuvants.

The use of liquid propellant compositions offers several significant advantages over comparable solid propellant compositions. For example, liquid propellant formulations are much more energetic than currently used solid compositions and have greater specific impulse. Increased specific impulse gives the missile a longer range and a higher velocity for the same weight of propellant charge.

A further superiority of liquid propellants over solid propellants is that the combustion of liquid propellants can be mechanically controlled during flight. Combustion can be stopped and started at will by controlling the flow of the propellant into the combustion chamber. Reducing the flow of the propellant into the combustion chamber decreases the thrust of the propellant while increasing the flow rate has the opposite effect. Since the heterogeneous propellants of this invention are in the liquid state when utilized, their flow rate can be controlled mechanically. This control is accomplished by adjusting the pumps and valves in the missiles fuels transport system.

The significance of mechanical control is that all liquid propellant systems have a "built-in" throttleability feature that is absent in solid propellants. Throttleability allows the missiles velocity to be varied, controls the attitude of the missile, makes evasive action possible, permits the rendezvous of two or more space ships during flight and reduces the hazards of landing.

In contrast, since solid propellants cannot flow, no comparable fuel transport takes place and no comparable control of combustion through varying the flow rate is possible. In fact, using the present technology, no method is presently available to control the combustion of the solid propellant charge after ignition. Thus, the difference of physical state alone makes all solid propellants inherently disadvantageous to liquid propellants for many applications.

Further significant disadvantages of solid propellants compared to liquid propellants arise in a number of ways because of the extreme sensitivity of solid propellants toward temperature and pressure fluctuations. This occurs both during storage and use. For example, the temperature of a solid propellant grain substantially influences performance. A given grain of solid propellant will produce more thrust on a hot day than on a cold day. Further, the physical state of the solid propellant is affected by temperature extremes. For instance, at a very low temperature many solid propellants become brittle and subject to cracking. Cracks in the propellant grain increase the propellants burning rate significantly and can cause a fracture or explosion. On the other hand a solid propellant exposed to high temperatures prior to firing can lose its shape and have its performance adversely affected. This sensitivity of solid propellants toward temperature fluctuation necessitates expensive storage under constant temperature prior to use.

For all of the foregoing reasons solid propellants are presently inferior to comparable liquid propellant compositions for many applications.

Even more advantageous than liquid propellants per se are liquid monopropellant compositions. These monopropellant formulations unlike bi-propellant formulations contain oxidizer, fuel and any other required adjuvant materials, combined and stored as a single formulation. Since these formulations already have sufficient oxygen no additional source of oxidizer is required and they can be handled after formulation as a single complete composition. Thus, only one storage tank and but one pumping system is needed both on the ground and in the missile. In contrast, bipropellant formulations consist of at least two separate compositions since the fuel and oxidizer components are kept physically separate until they are injected into the missiles combustion chamber. Both at the storage facility and in the missile, duplicate storage and pumping systems are essential. Furthermore, in many instances wherein the oxidizer is a gas such as oxygen, the oxidizer must be refrigerated under high pressure. Halving the pumping and storage requirements, particularly the pumping system, reduces the mechanical complexity of the fuel transport system and decreases the likelihood of mechanical malfunction of the missile. In addition, the need for only one set of storage and pumping facilities greatly simplifies design and construction of the missile, decreases the weight of the hardware and increases the fuel load of the missile. An ancillary but not unimportant result of simplifying the transport and storage systems is the reduction of maintenance time and maintenance and storage costs.

Unfortunately, while monopropellant formulations offer all of the above enumerated advantages over bipropellant formulations, these advantages heretofore have been largely unrealized. The reasons for this have been several. Among other things, monopropellant compositions have been too easily ignited, become unstable upon prolonged storage, too readily detonated upon being disturbed and give erratic and relatively poor performance.

For example, the prior art monopropellant compositions are typified by the following: heptane-nitrogen tetraoxide, n-propyl nitrate, nitromethane, propargyl nitrate-nitramine and the like. All of these materials suffer from the failing of poor thermal stability, high sensitivity toward detonation and/or the tendency to deteriorate under prolonged storage. Poor thermal stability requires refrigerated storage, while a high sensitivity toward detonation by shock makes the propellants hazardous to store, transport and use. The deterioration of propellants after prolonged storage causes erratic performance and makes it continually necessary to substitute fresh propellant for aged propellant in order to maintain the initial high specific impulse. These stability factors among others greatly negate the value of the liquid monopropellants particularly in military retaliatory weapons.

An additional disadvantage of bipropellant liquids compared to monopropellants is in the criticality of the oxidizer to fuel ratio and the narrow margin of malfunction allowed in the performance of the fuel metering and injection system.

While the oxidizer to fuel ratio is extremely critical to performance in all liquid propellants, in monopropellants the demands are much less stringent. This is because the oxidizer is added to the fuel during formulation and prior to use. Therefore the critical oxidizer to fuel ratio in monopropellants can be accurately determined and corrected if necessary to assure optimum performance prior to firing. In bipropellants this adjustment of oxidizer to fuel ratio cannot be made prior to firing. The reason for this is that the oxidizer and fuel are separately stored until they are injected into the missile combustion chamber for use. Thus the ratio of oxidizer to fuel in the final propellant mixture is determined only at the instant of firing and cannot be corrected. Since the metering device like any complex mechanism is subject to failure, a deviation or even abortion of the missile flight can result.

Since this malfunction cannot be foreseen until it occurs no preventive measures are possible. In a similar vein, because of the losses of fuel and oxidizer which are known to occur because of the injection and combining of the separate streams of fuel and oxidizer in the missile combustion chamber, it is necessary to store an additional supply of both propellant components in the rocket.

These losses of fuel and oxidizer are an inherent part of bipropellant systems and are referred to as outage losses. The extra weight of the outage reservoir reduces the payload, the missile could carry and hence is disadvantageous. All of these shortcomings of bipropellant liquids are absent in monopropellants since the propellant is premixed and requires no metering.

For the above reasons among many others, the preparation of liquid monopropellant formulations having high specific impulse is to be desired. Especially valuable would be liquid propellant formulations which retain their initial high specific impulse and/or density impulse yet remain relatively insensitive to detonation by shock. This type of a highly energetic liquid propellant would be a major advance in the propellant art. Ideally these formulations would combine a low freezing point with the aforementioned properties and could be prepared from commercially available innocous components and would have thixotropic properties. The low freezing point would prevent "freeze-up" during flight or storage while the thixotropic state would allow the formulations to be stored as a solid and pumped as a liquid.

Thus it is an object of this invention among others to prepare highly energetic, monopropellant formulations.

It is an additional object of this invention to prepare monopropellant compositions which retain their original high specific impulse and/or density impulse for relatively long periods of time.

Yet another object of this invention is to prepare thixotropic liquid monopropellant compositions which can be cast and stored as solid propellants yet can be pumped as liquid propellants.

Yet another object of this invention is to prepare liquid propellant compositions having a low freezing point and thixotropic properties.

It is still another object of this invention to prepare highly energetic liquid propellant compositions from readily available and individually safe components.

Still an additional object of this invention is to prepare propellant compositions which when utilized in the propulsion of torpedoes, boats and submarines leave a minimal wake.

Other objects of this invention will become apparent to those skilled in the propellant art by a further reading of this patent application.

These objects among others are achieved by the heterogeneous monopropellant compositions and processes described herein.

In practice, novel and superior thixotropic propellant compositions are derived by preparing uniform mixtures consisting of (a) inorganic phosphides, said fuels being in finely divided form (b) liquid oxidizer and (c) thixotroping agents with or without propellant adjuvants.

More specifically, propellant compositions of this invention consist essentially of:

A. from about 15 to 50 parts by weight of a finely divided solid fuel selected from the group consisting of inorganic phosphides, phosphide alloys and mixtures of these inorganic phosphides and phosphide alloys.

B. from about 50–95 parts by weight of liquid oxidizer.

C. up to about 10 parts by weight of thixotroping agents with or without optional propellant adjuvants.

These latter propellant adjuvants include surface active agents, conditioning agents, modifiers and the like which while not necessary for operable propellant compositions, are desirable for optimum performance. The propellant adjuvants change, modify or impart to the propellant certain desirable physical and combustion characteristics so that they can be most effectively used. Typical adjuvants include surface active agents, viscosity modifiers, combustion catalysts, stabilizing agents and the like. Where such adjuvants are used they will more customarily comprise between about one-half to 6 parts by weight of the final propellant compositions.

The above components of the propellant composition are thoroughly mixed or blended to form a uniform thixotropic mixture then pumped into the rocket motor as a viscous liquid which soon sets to a gel. When the propellant is to be ignited it is exposed to a shearing force converting it to a pumpable liquid. The liquid is then pumped into the combustion chamber for use. The pumping procedures are well known in the propellant art. Since the propellant compositions contain at least three classes of ingredients, it is essential for satisfactory performance that the composition be uniform in content. Thus throughout this disclosure and claims the propellant composition referred to are understood to be those uniform in content.

A. Fuel

The fuels referred to throughout this application are selected from the group consisting of inorganic phosphides. Illustrative phosphides include among others: aluminum, lithium, boron, beryllium, titanium, nickel and mixtures of these phosphides. While all of the above fuels are better than average in the inventive compositions, the preferred fuel embodiments of this invention are boron, beryllium and titanium phosphides. The boron phosphide fuel is in the crystalline rather than the amorphous form.

The inorganic phosphide fuels of this invention are all known compounds described in the technical and patent literature. For example, Chemical Abstract and Treatises by Mellor and Ephraim describe the preparation of these fuels. A recent U.S. Pat. (No. 3,114,605) describes a process for preparing the preferred crystalline boron phosphide.

B. Liquid oxidizers

The liquid oxidizers of this invention are of diverse structure and origin. Among the various oxidizers which can be used are the following: nitric acid, nitric acid enriched with $NO_2$ (RFNA), and nitric acid enriched with $NO_2$ and HF (IRFNA and HIRFNA) nitrogen tetraoxide ($N_2O_4$), concentrated hydrogen peroxide ($H_2O_2$), perchloryl fluoride ($ClO_3F$), tetrafluorohydrazine ($N_2F_4$), tetranitromethane ($C(NO_2)_4$), the various nitroglycols, concentrated perchloric acid (for example the dihydrate) and the like. The preferred oxidizers of this invention are concentrated $H_2O_2$, $N_2O_4$, $HClO_4$, $ClO_3F$. Generally these oxidizers are preferred because of their low cost, commercial availability and most important, because of the highly energetic propellant compositions that are produced when they are used in conjunction with the aforenamed fuel components.

C. Thixotropic Agents or Gelling Agents

These agents which are alternatively referred to as thickening agents are used to thicken the propellant compositions so that they can be stored as thixotropic solids, yet under a shearing force will revert to the liquid state. These gelling or thickening agents can be present in amounts ranging from 0 to 6 parts by weight or higher. More generally the thickener will be used in amounts ranging from 1 to 4 parts by weight. The exact amounts used will depend upon the type and amount of the particular fuel and oxidizer used as well as the thickener employed. An abbreviated but illustrative list of thickeners includes among others the preferred thickener, powdered carbon, the various anhydrous and particulate colloidal silicas, colloidal clays such as bentonite, the alkoxy celluloses such as methoxy-, ethoxy and propoxy celluloses, the vegetable gums, alginic acid and its salts, polyols, resins and the like.

D. Optional "Propellant Adjuvant"

This is the generic designation used to describe the various conditioning, modifying agents, solvents and the like used to produce optimum performance from the propellant compositions of this invention. These adjuvants ordinarily make up a minor proportion of the final propellant composition, seldom exceeding 10 parts by weight of the propellant composition and more typically comprising 0 – 6 parts by weight of the compounded propellant exclusive of thixotropic agents. The adjuvants listed previously are the most important utilized although many other adjuvants can be employed if desired.

E. Compounding the Propellant Formulations

In preparing the novel liquid propellant formulations of this invention, several compounding procedures among many can be followed. The following represents the preferred formulative procedure:

The weighted, dry solid fuel ingredient(s) of the formulation are mixed until a homogeneous and uniform solid mixture is obtained. The mixing or blending operation can be accomplished using any number of commercial tumblers, blenders, agitators or mixers. Since the components are not detonatable both individually and as a mixture, no special precautions in mixing need to be taken. When the solid ingredients have been satisfactorily blended they are added to the required amount of liquid oxidizer until a highly viscous liquid thixotropic mixture is obtained. This gelled propellant mixture is pumped into a rocket engine as a viscous liquid and rapidly sets to a heavy gel. When the gel is exposed to a shear force, it liquifies and its viscosity and flow rate into the missile combustion chamber can be controlled mechanically as is the case in a typical liquid propellant composition.

Because of their exceptional stability, the novel heterogeneous propellants of this invention are preferably ignited using any one of several possible techniques. One method is referred to as the hypergolic technique. In this method a small amount of chemical agent reactive with one or more of the propellant components is injected into the missile's combustion chamber with the flow of propellant mixture. The ignition is initiated by the reaction of chemical agent with the propellant components and the propellant once ignited burns smoothly. A satisfactory chemical agent for this purpose among others is unsymmetrical dimethyl hydrazine.

In a second method, the combustion is initiated using a squib of solid propellant. The ignition of the solid propellant can be electrically actuated.

F. Preferred Heterogeneous Monopropellant Compositions

As indicated supra many different factors are involved in determining whether a given propellant composition is to be favored over another. Among these factors are high specific impulse, high density impulse, insensitivity toward detonation, cost, availability of the components as well as the type of use contemplated. For use as rocket propellants the most preferred heterogeneous monopropellants consist essentially of the following.

15 to 50 parts by weight of a solid fuel selected from the group of fuels consisting of aluminum, beryllium, boron lithium, nickel and titanium phosphides as well as their alloys and mixtures of these alloys and phosphides.

50 to 95 parts by weight of a liquid oxidizer selected from the group consisting of perchloryl fluoride, nitrogen tetraoxide, and concentrated hydrogen peroxide (perferably above 90%) and perchloric acid dihydrate, and from about 1 to 7 parts by weight of thixotroping or gelling agent(s).

The workings of this invention can be shown more clearly by the typical embodiments which follow below.

In one preferred embodiment of this invention a heterogeneous propellant composition is prepared utilizing crystalline boron phosphide as the solid fuel and perchloric acid dihydrate as liquid oxidizer. The preparation is as follows.

A 25 parts by weight portion of powdered crystalline boron phosphide fuel and 5 parts by weight of silica (having a particle size of 7 – 10 millimicron and a surface area of 300 – 350 sq. meters/gram) are blended in a PREMIER Dispersator fitted with a 1 inch Duplex Head. The mixing time is 15 minutes. The blended bimodal mixture is added to a 70 parts by weight of perchloric acid dihydrate in the same type of dispersator. Again the blending is continued for 15 minutes. A highly viscous gel is obtained which has a specific impulse of about 196 and a density impulse of 380.

In another embodiment using the same equipment and blending time and techniques as before, an aluminum phosphide based propellant is prepared by blending a previously blended mixture of 5 parts by weight of finely divided silica thickener (7–10 millimicrons and a surface area of 300–500 sq. meters/gram and 31 parts by weight of powdered aluminum phosphide with 64 parts by weight of $H_2O_2$ oxidizer. Again a viscous highly energetic gel is obtained.

In still another embodiment of this invention another propellant formulation is prepared as above: 35 parts by weight portion of powdered titanium phosphide fuel, 5 parts by weight of silica thickener described above and 60 parts by weight of $HClO_4.2H_2O$ oxidizer.

In the following additional embodiments the phosphide component is blended with 5 parts by weight of powdered silica and is added to stoichiometric proportion of the indicated liquid oxidizer. The first blending step takes 25 minutes, the second 15 minutes. The stoichiometry of the system is computed to favor the production of the metal oxide and $PO_2$ as combustion products.

| Phosphide | Liquid Oxidizer |
|---|---|
| Magnesium phosphide | $HClO_4.2H_2O$ |
| Aluminum phosphide | HIRFNA |
| Calcium phosphide | IRFNA |
| Beryllium phosphide | $N_2O_4$ |
| Lithium phosphide | $H_2O_2$ |
| Titanium phosphide | $N_2O_4$ |
| Titanium phosphide | IRFNA |
| Titanium phosphide | RFNA |
| Titanium phosphide | $ClO_3F$ |
| Nickel phosphide | IRFNA |
| Nickel phosphide | HIRFNA |

A 42 parts by weight portion of beryllium phosphide and 3 parts by weight of the afore-mentioned fine particle size silica are blended for 30 minutes. After the blending is completed 55 parts by weight of 98% $H_2O_2$ oxidizer is added to the blend and the blending is resumed for an additional 15 minutes. A gel-like propellant having a specific impulse of approximately 251 is produced. ISPD is 398.

One of the advantageous applications of the crystalline boron phosphide fuel is as a component of so called wakeless torpedos or wakeless propellant mixture for propelling submarines and boats having a reaction type motor. The following embodiments are illustrative of these applications.

In another embodiment using the same equipment and blending time and techniques previously described the following wakeless propellant compositions are prepared: a 5 parts by weight portion of finely divided silica thickener (7–10 millimicrons and a surface area of 300–500 sq. meters/gram) is blended with 31 parts by weight of powdered crystalline boron phosphide and 64 parts by weight of $ClO_3F$ oxidizer. A viscous, highly energetic gel type propellant is obtained.

In still another embodiment of this wakeless propellant, a formulation is prepared as above: 32 parts by weight portion of powdered crystalline boron phosphide, 4 parts by weight of silica thickener described above and 64 parts by weight of 98% $H_2O_2$ oxidizer.

A 30 parts by weight portion of crystalline boron phosphide particles is blended for 20 minutes with 5 parts by weight of silica (7–10 millimicrons and 300–350 sq. meter/gram). At the end of this time a 65 parts by weight portion of $N_2O_4$ is blended in for an additional 20 minutes. The resultant propellant is a thick gel and is relatively stable upon storage at room temperature.

As indicated by the many illustrative embodiments disclosed throughout this application, numerous modifications and variations can be made in the invention without departing from the inventive concept. Thus the metes and bounds of this invention can best be determined by an examination of the claims which follow.

We claim:

1. Novel thixotropic, monopropellant compositions comprising a mixture of a solid fuel selected from the group consisting of inorganic phosphides, phosphide alloys and mixtures of these inorganic phosphides and phosphide alloys, a liquid oxidizer selected from the group consisting of nitric acid, nitric acid enriched with $NO_2$, nitric acid enriched with $NO_2$ and HF, nitrogen tetroxide, hydrogen peroxide, perchloryl fluoride, tetrafluorohydrazine, tetranitro methane and perchloric acid, and a thixotropic agent selected from the group consisting of particulated carbon and silica.

2. The thixotropic monopropellant compositions of claim 1 wherein the components are present in about the following proportions:

15–50 parts by weight of solid fuel
50–95 parts by weight of liquid oxidizer and
up to 10 parts by weight of thixotroping agent.

3. The thixotropic monopropellant compositions of claim 2 wherein up to 6 parts by weight of propellant adjuvants are present.

4. The thixotropic monopropellant compositions of claim 2 wherein the solid fuel is crystalline boron phosphide.

5. The thixotropic monopropellant compositions of claim 2 wherein the solid fuel is a titanium phosphide.

6. The thixotropic monopropellant compositions of claim 2 wherein the solid fuel is a beryllium phosphide.

7. The thixotropic monopropellant compositions of claim 2 wherein the solid fuel is aluminum phosphide.

8. The thixotropic monopropellant compositions of claim 2 wherein the solid fuel is a lithium phosphide.

9. The thixotropic monopropellant compositions of claim 2 wherein the solid fuel is nickel phosphide.

10. The thixotropic monopropellant compositions of claim 2 wherein the solid fuel is a mixture of inorganic phosphides and phosphide alloys.

11. A thixotropic monopropellant composition comprising a mixture of from about 15–50 parts by weight of solid fuel selected from the group of inorganic phosphides consisting of beryllium phosphide, aluminum phosphide, boron phosphide, titanium phosphide, lithium phosphide, nickel phosphide and mixtures of these phosphides, from about 50–95 parts by weight of a liquid oxidizer selected from the group consisting of nitric acid, nitric acid enriched with $NO_2$, nitric acid enriched with $NO_2$ and HF $N_2O_4$, concentrated $H_2O_2$, $C10_3F$, concentrated $HClO_4$, $N_2F_4$, and $C(NO_2)_4$ and up to about 10 parts by weight of a thixotroping agent selected from the group consisting of particulated carbon and silica.

12. A thixotropic monopropellant composition comprising a mixture of:

from about 15–50 parts by weight of crystalline boron phosphide
from about 50–95 parts by weight of liquid oxidizers selected from the group consisting of concentrated $H_2O_2$, $N_2O_4$ and $ClO_3F$, and up to 10 parts by weight of thioxtroping agent selected from the group consisting of particulated carbon and silica.

13. A thixotropic monopropellant composition comprising a mixture of:

from about 15–50 parts by weight of aluminum phosphide from about 50–95 parts by weight of liquid oxidizer selected from the group consisting of concentrated $H_2O_2$, $N_2O_4$, and $ClO_3F$, and up to 10 parts by weight of thixotroping agent selected from the group consisting of particulated carbon and silica.

14. A thixotropic monopropellant composition comprising a mixture of:

from about 15–50 parts by weight of beryllium phosphide from about 50–95 parts by weight of liquid oxidizer selected from the group consisting of water, concentrated $H_2O_2$, $N_2O_4$, and $ClO_3F$, and up to 10 parts by weight of thixotroping agent selected from the group consisting of particulated carbon and silica.

15. A thixotropic monopropellant composition comprising a mixture of:

from about 15–50 parts by weight of titanium phosphide from about 50–95 parts by weight of liquid oxidizer selected from the group consisting of water, concentrated $H_2O_2$, $N_2O_4$, $ClO_3F$ and water, and up to 10 parts by weight of thixotroping agent selected from the group consisting of particulated carbon and silica.

16. A thixotropic monopropellant composition comprising a mixture of:

from about 15–50 parts by weight of lithium phosphide from about 50–95 parts by weight of liquid oxidizer selected from the group consisting of water, concentrated $H_2O_2$, $N_2O_4$, $ClO_3F$ and water, and up to 10 parts by weight of thixotroping agent selected from the group consisting of particulated carbon and silica.

17. A thixotropic monopropellant composition comprising a mixture of:

from about 15–50 parts by weight of nickel phosphide from about 50–95 parts by weight of liquid oxidizer selected from the group consisting of water, concentrated $H_2O_2$, $N_2O_4$, $ClO_3F$ and water, and up to 10 parts by weight of thixotroping agent selected from the group consisting of particulated carbon and silica.

* * * * *